US008511037B2

(12) United States Patent
Way

(10) Patent No.: US 8,511,037 B2
(45) Date of Patent: Aug. 20, 2013

(54) MULTI-STOREY INSULATED CONCRETE FORM STRUCTURE HAVING OPENINGS AND METHOD OF CONSTRUCTION

(76) Inventor: Alven J. Way, Waterloo (CA)

( * ) Notice: Subject to any disclaimer, the term of this patent is extended or adjusted under 35 U.S.C. 154(b) by 0 days.

(21) Appl. No.: 13/368,868

(22) Filed: Feb. 8, 2012

(65) Prior Publication Data

US 2012/0204510 A1 Aug. 16, 2012

Related U.S. Application Data

(63) Continuation of application No. 11/872,894, filed on Oct. 16, 2007, now abandoned.

(51) Int. Cl.
*E04G 21/00* (2006.01)

(52) U.S. Cl.
USPC ..... 52/742.14; 52/425; 52/426; 52/745.16

(58) Field of Classification Search
USPC ..... 52/745.15, 745.16, 742.14, 745.09, 52/415, 424, 425
See application file for complete search history.

(56) References Cited

U.S. PATENT DOCUMENTS

| | | | | |
|---|---|---|---|---|
| 3,451,184 | A * | 6/1969 | Stewart | 52/577 |
| 4,314,430 | A * | 2/1982 | Farrington | 52/206 |
| 5,246,640 | A * | 9/1993 | Bryant | 264/35 |
| 5,927,043 | A * | 7/1999 | Newkirk | 52/742.14 |
| 7,587,868 | B2 * | 9/2009 | Hughes | 52/215 |
| 2005/0210785 | A1 * | 9/2005 | Way | 52/295 |

* cited by examiner

*Primary Examiner* — Brian Glessner
*Assistant Examiner* — Adam Barlow
(74) *Attorney, Agent, or Firm* — Etienne de Villiers; Dimock Stratton LLP

(57) ABSTRACT

An insulated concrete form structure is provided that includes a structure opening through the structure. The structure opening being defined by form edges and opening forms bonded to a concrete core of the structure. A method is provided that includes erecting a set of spaced apart forms on a base, positioning opening forms in the space between the forms around a form opening through the forms, securing the opening forms around the form opening, and pouring concrete to fill the space between the forms, around the opening forms, to a top portion of the forms, thus creating the concrete core of the structure.

6 Claims, 6 Drawing Sheets

MULTI-STOREY INSULATED CONCRETE FORM STRUCTURE HAVING OPENINGS AND METHOD OF CONSTRUCTION

CROSS-REFERENCE TO RELATED APPLICATIONS

This application is a continuation application of application Ser. No. 11/872,894, filed Oct. 16, 2007, which is incorporated herein by reference.

FIELD OF THE INVENTION

This invention relates to insulated concrete form construction methods and walls and buildings constructed using insulated concrete forms.

BACKGROUND OF THE INVENTION

Insulated concrete form (ICF) construction techniques typically involve fixing two foam forms a fixed distance apart and pouring concrete between the forms. After the concrete has set, the foam forms remain in place to provide insulation for the concrete structure. Reinforcing members, such as rebar or mesh, may be located in the gap between the forms before the pour to become embedded in the concrete and provide reinforcement to the structure after the concrete sets.

Foam forms for ICF construction typically have ties that hold the two foam layers a set distance apart during the concrete pour. An example of a suitable foam form are Nudura (trademark) forms, though other suitable forms are also commercially available comprising a high enough density and appropriate chemical formula to meet the fire requirements. While the present application only illustrates straight foam forms for straight walls comprising two planar rectangular foam layers for ease of illustration, forms for alternate wall configurations including angles, corners and curves may also similarly be used.

Multi-storey concrete structures have traditionally not been constructed using ICF due to the difficulties in maintaining alignment of the forms during the pour. While ICF is used for construction near ground level, inaccuracies in alignment tend to become exaggerated with each additional storey of construction making their use in multi-storey structures more problematic. Deviations in the forms during the pour require repairs to the foam and concrete structure that are difficult, time consuming and expensive.

One aspect of the difficulties faced in building multi-storey concrete structures using ICF construction techniques has been the lack of ready access to the outside of the structure during construction above the first storey. Another aspect of the difficulties faced in building multi-storey concrete structures using ICF construction techniques has been the difficulty in creating openings through the structure including openings to accommodate windows, doors, sliding doors, glass blocks. A further aspect of the difficulties faced in building multi-storey concrete structures using ICF construction techniques has been creating openings through the structure at upper storey locations where access to the outside of the structure during construction is limited.

Wooden frame openings are a standard residential construction technique used in wood frame residential structures that have been adapted for use in ICF structures. One method of creating openings using ICF construction techniques has been to cut the opening through the forms and create a wooden frame around the shape of the intended opening. After erecting the forms on a suitable base, the permanent wooden frame about the shape of the opening is inserted between the forms. The wooden frame is then braced and concrete poured in at the top of the forms to fill the wall. A waterproof membrane is typically applied over the frame and adjoining area of the forms to prevent moisture from entering the ICF structure. A limitation of this construction technique is that the wooden frame remains in the ICF structure.

An advantage of ICF structures in general is that they are not prone to rot or ingress of water into the structure. The use of a wooden frame may cause complications as wood may react with the concrete, rot over time, or allow ingress of water if the membrane is damaged. A further limitation of using permanent wooden frames is that voids may form in the concrete beneath the frame. A further limitation of using permanent wooden frames is that the portion of the ICF structure bounded by the wooden frame is not thermally sealed compared to the portion of the ICF structure bounded by the insulated forms. A further limitation of using permanent wooden frames is that some building codes restrict the use of wood in contact with concrete for concrete structures.

There is a need for a system and method of ICF construction for creating openings through a multi-storey concrete structure.

There is a further need for a system and method of ICF construction that creates openings through a multi-storey concrete structure without the need for a permanent wooden frame embedded in the structure.

BRIEF DESCRIPTION OF THE DRAWINGS

In drawings which illustrate by way of example only a preferred embodiment of the invention, FIG. 1 A is an illustration of an ICF structure.

DETAILED DESCRIPTION OF THE INVENTION

There is provided a method of constructing an insulated concrete form structure having a structure opening through the structure, the structure opening defined by form edges and opening forms bonded to a concrete core of the structure, the method comprising erecting a set of spaced apart forms on a base; positioning opening forms in the space between the forms around a form opening through the forms; securing the opening forms around the form opening; and, pouring concrete to fill the space between the forms, around the opening forms, to a top portion of the forms, creating the concrete core of the structure; whereby the opening forms bond to the concrete core, the opening forms and the form edges defining the structure opening.

The method may further comprise, while positioning the opening forms, leaving an opening forms gap at a lower portion of the forms opening; pouring a first pour of concrete to fill the space between the forms upto the gap of opening forms; positioning opening forms to close the opening forms gap and allowing the first pour of concrete to set; pouring a second pour of concrete to fill the space between the forms from the top of the first pour around the opening forms to a top portion of the forms.

Additionally, the method may comprise after pouring the first pour of concrete, agitating the concrete before positioning opening forms to close the opening forms gap. The agitator may be inserted through the opening forms gap to agitate the concrete.

There is provided an insulated concrete from structure having been constructed using the above methods.

There is provided an insulated concrete form structure having a structure opening through the structure, the structure opening defined by opening edges of the forms and opening forms bonded to a concrete core of the structure, the structure comprising a set of forms erected on a base; the forms spaced apart to define a gap-bounded by the forms; the gap filled with a concrete core; a forms opening through the forms and a concrete opening through the concrete core; a perimeter of the structure opening defined by the opening edges of the forms and a set of opening forms; the opening forms spanning the gap at the opening edges; one surface of the opening forms bonded to the concrete core and defining the concrete opening and an opposite surface of the opening forms defining the structure opening; whereby the opening forms insulate the concrete core and provide a moisture barrier between the concrete core and the structure opening.

The opening forms of the structure may further comprise ties affixed to the surface of the opening forms bonded to the concrete, and extending into and terminating in the concrete core; the ties bonded to the concrete core.

Figure 1A:
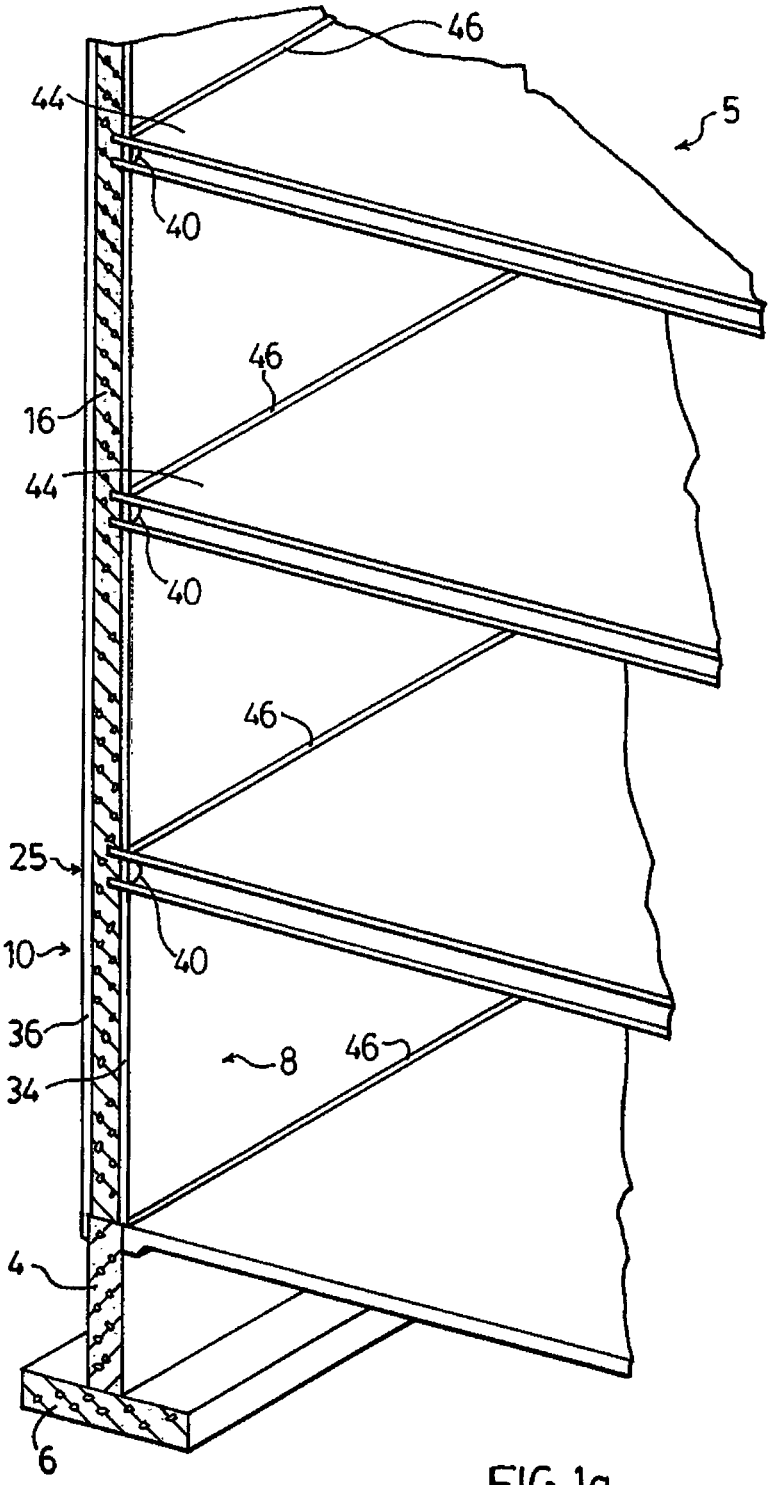
FIG. 1 B is an isometric illustration of a set of ICF forms having an opening.

In FIG. 1*a* illustrates a section of a portion of a multi-storey concrete structure 5. The concrete structure illustrated comprises a wall 25 supported by a foundation 4 located on a footing 6. The wall 25 comprises an inside form 8 and an outside form 10. Between the inside form 8 and an outside form 10 is concrete 16, ties linking the forms 8, 10 and reinforcement such as steel rebar or mesh. The multi-storey concrete structure 5 includes multiple floors 44. The forms 8, 10 may either be single panels extending the full height of the storey, or alternatively, may comprise multiple panels stacked to reach the full height of the storey.

During construction, the forms 8, 10 are erected spaced apart on a base with the reinforcement located in the space between the forms 8, 10. Concrete may then be poured into the space between the forms 8, 10. Concrete agitators (not shown) may be used to remove voids from the fresh concrete. After the concrete has had sufficient time to cure and set to comprise a concrete structure, the forms 8, 10 may stay in place to provide insulation of the structure.

Figure 1B:
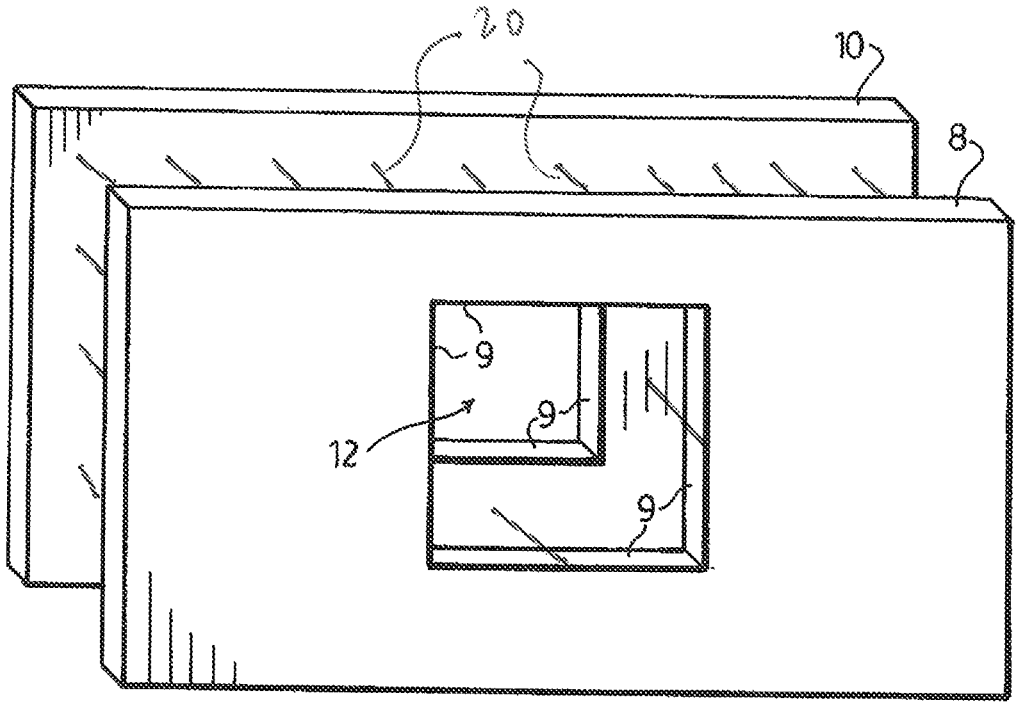
Figure 2:
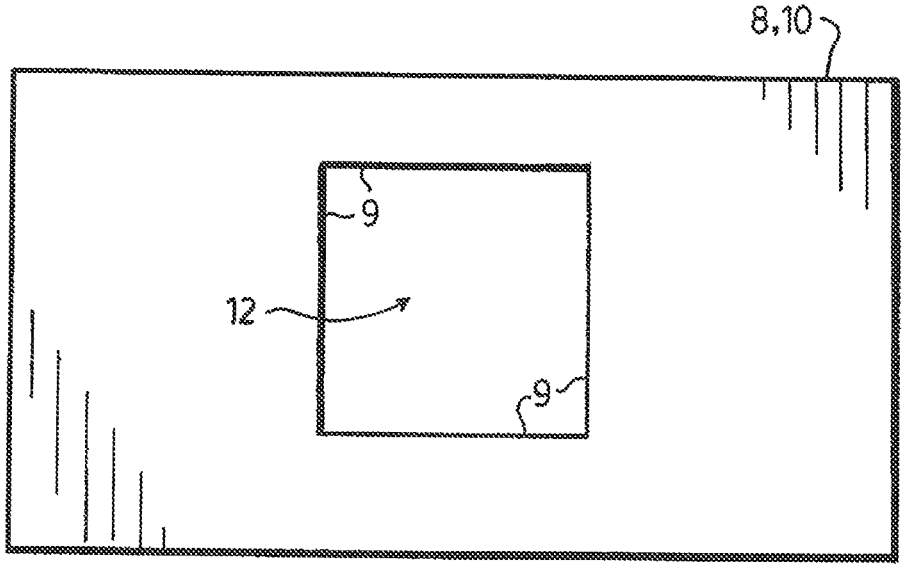
FIG. 2 is a side view of the forms of FIG. 1.
Figure 3:
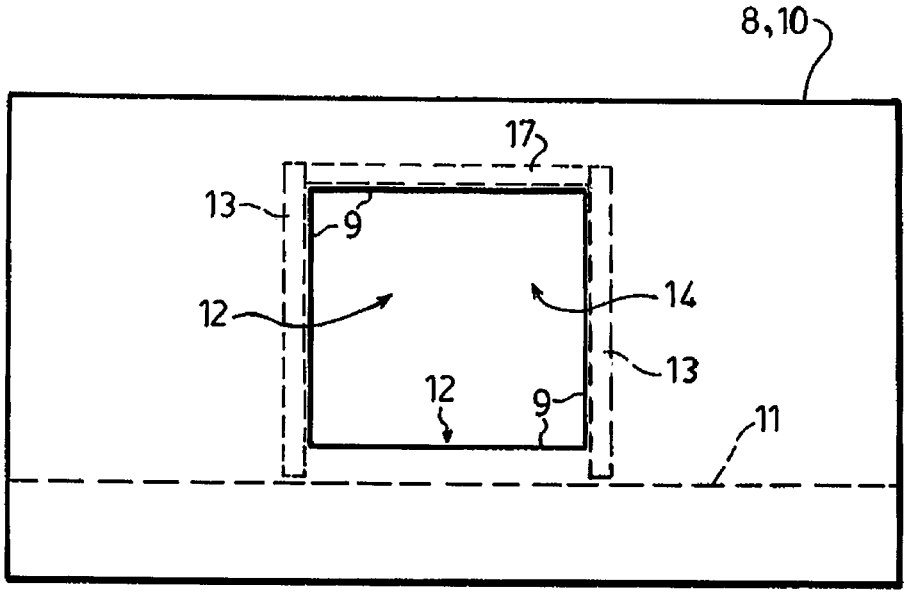
FIG. 3 illustrates the forms with opening forms in place in anticipation for a first concrete pour according to an embodiment of an ICF method.

FIG. 1*b* is an isometric view and FIG. 2 is a side view of a set of forms 8, 10 with a form opening 12 through the forms 8, 10 defined by form edges 9. FIG. 3 illustrates a side view of the set of forms 8, 10 with opening forms 13, 15, 17 sized to span the space between the forms 8, 10 and positioned around the form opening 12 to define a structure opening 14 along with the form edges 9. The reinforcement is not shown in these figures for illustrative purposes only, but it is understood that reinforcement would also be positioned in the space between the forms 8, 10.

In situations where the structure opening 14 is relatively wide, or its lower portion 12 is located relatively close to a lower portion of the forms 8, 10, it is desirable to utilise a two-step concrete pour as described below. In the embodiment illustrated in FIG. 3, the opening form 15 (not visible in this Figure) in a lower portion 12 of the structure opening 14 has been omitted at this stage of the construction.

The positioned opening forms 13, 17 are preferably braced using temporary bulkheads 25 (not shown in this Figure) affixed to the forms 8, 10 and optionally additional supports 26 (not shown in this Figure) across the structure opening 14. While it is not necessary to position the temporary bulkheads 25 for the upper opening form 17 at this time, it is desirable to do so to protect the opening form 17 from inadvertent concrete pour.

A first concrete pour may be made to a bottom portion of the opening forms 13 to either side of the structure opening 14 upto a pour line 11. It is desirable to size the opening forms 13 to extend past the structure opening 14 a width of the lower opening form 15 to be positioned in the lower portion 12 of the structure opening 14. In this fashion the lower portion of the opening forms 13 indicates a preferred level of the pour line 11.

Omitting the opening form 15 in a lower portion 12 of the structure opening 14 allows for visual inspection of the level of the concrete during the pour and to ensure no voids form in the concrete below the lower portion 12 of the structure opening 14. After completing the pour to the pour line 11, the concrete may be agitated by inserting a concrete agitator into the concrete accessible through the form opening 12.

Figure 4:
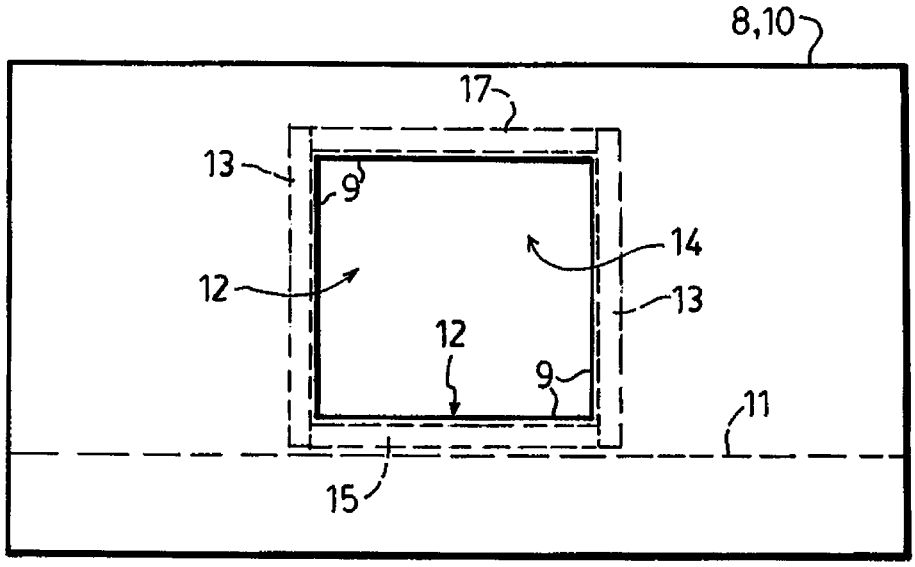
FIG. 4 illustrates the forms with opening forms in place after the first concrete pour according to an embodiment of an ICF method.

After agitation the concrete below the lower portion 12 of the structure opening 14 is preferably dressed and leveled to provide a bonding surface to receive the opening form 15 to be positioned in the lower portion 12 of the structure opening 14. After the concrete has been dressed and leveled, the opening form 15 may be positioned on the concrete surface in the lower portion of the structure opening 14 as illustrated in FIG. 4.

After the concrete of the first pour has sufficiently set, a support 26 may be erected using the opening form 15 positioned in the lower portion of the structure opening 14 as a base to support the opening form 17 positioned in the upper portion of the structure opening 14. After completing bracing, a second concrete pour may fill the space between the forms 8, 10 from a level of the first pour to an upper portion of the forms 8, 10 around the structure opening 14.

Opening forms 13, 15 and 17 may preferably be sized from scrap cuttings of forms 8, 10 used at a building site. For instance, forms 8, 10 may be cut to create the forms opening 12. The cutting may be sized to create opening forms 13, 15 and 17. Preferably the opening forms 13, 15 and 17 are sized in length to span lengths of the forms opening 12 in a single piece and sized in width to form a friction-fit engagement with the forms 8, 10.

Preferably, opening forms 13, 15 and 17 include tie remnants 21 affixed to one surface of the opening forms 13, 15 and 17. The forms 8, 10 are typically joined by ties 20 affixed to a surface of each form 9, 10 and spanning the space between the forms. When cutting the forms, it is preferably to cut the form ties 20 at roughly a mid-point along the length of the ties 20 to leave a tie remnant 21 on each form cutting.

When positioning the opening forms 13, 15 and 17, it is preferable to locate the surface covered in tie remnants 21 facing the space between the forms 8, 10. In this fashion both the surface of the opening forms 13, 15 and 17 and the tie remnants 21 bonds to the concrete core 16.

Figure 10:
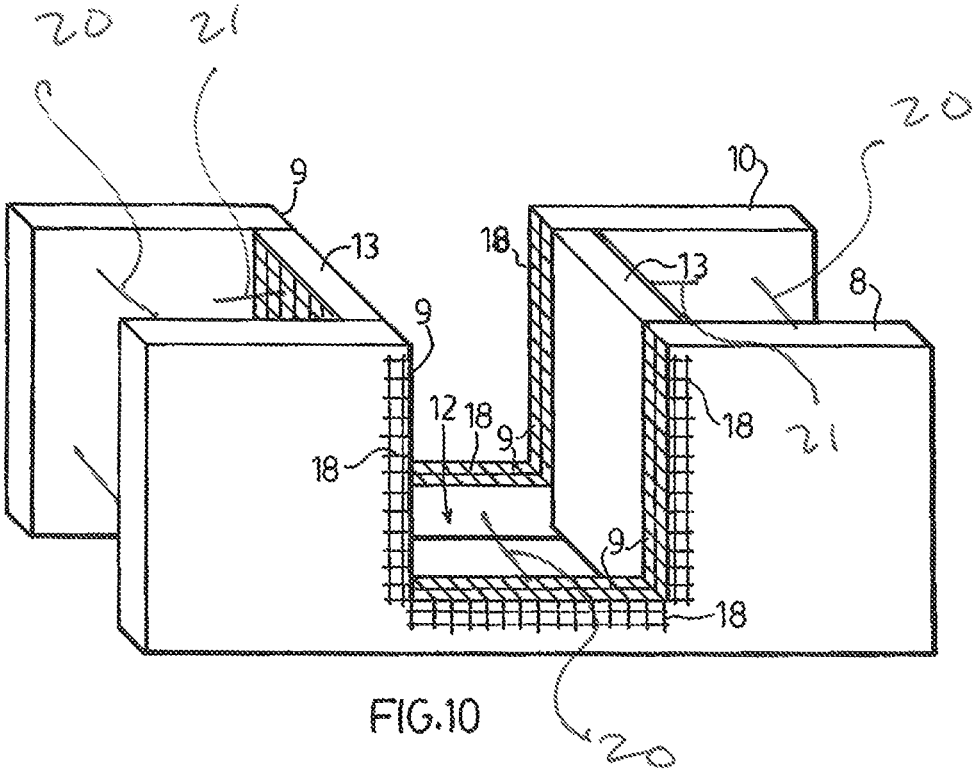
FIG. 10 is an isometric section view of the forms with opening forms in place with a mesh underlay in anticipation for a first concrete pour according to an embodiment of an ICF method.

If a stucco exterior is being applied to the forms 8, 10, a mesh 18 may be fitted in with the opening forms 13, 15 and 17 as illustrated in FIG. 10. Mesh 18 is secured by concrete bonding through the mesh into surface of the forms 8, 10 and optionally to the tie remnants 21.

Figure 5:
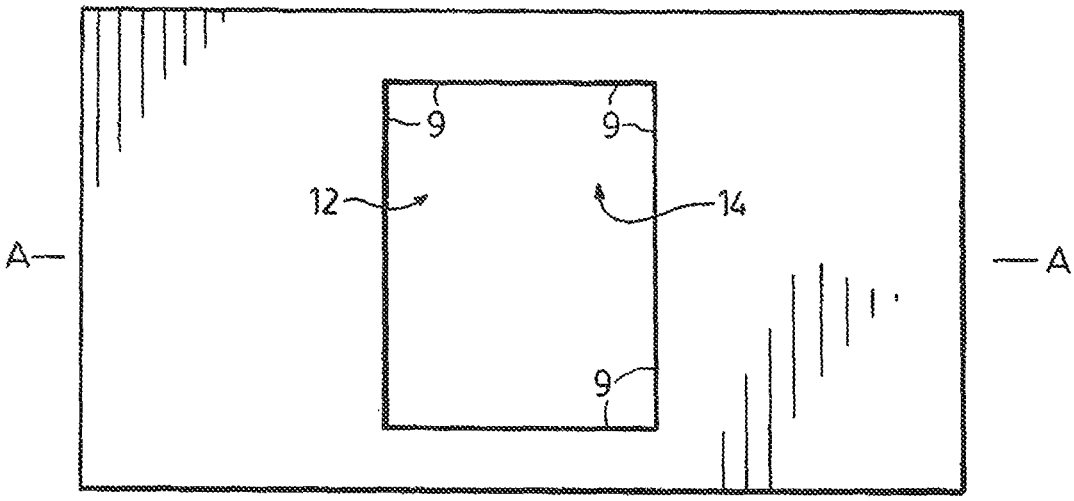
FIG. 5 is a side view illustration of the forms identifying a section plane AA through the forms.
Figure 7:
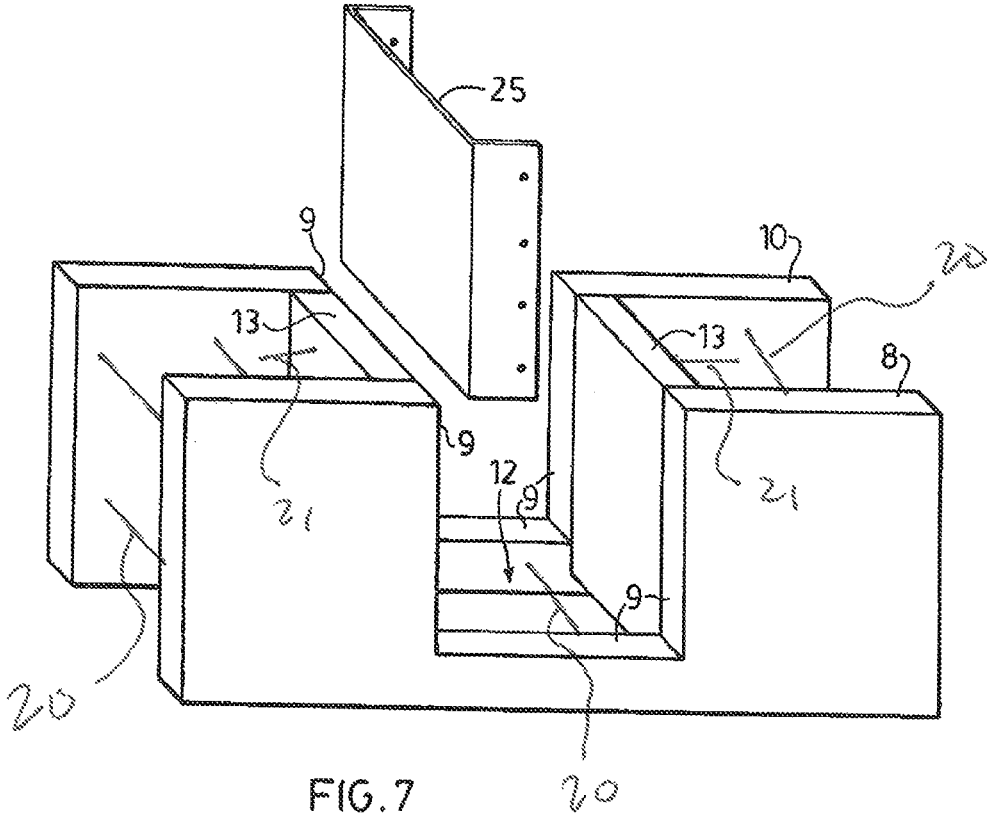
FIG. 7 is an isometric section view of the forms with opening forms in place and a bulkhead to be affixed to the forms to support the opening forms in anticipation for a first concrete pour according to an embodiment of an ICF method.
Figure 8:
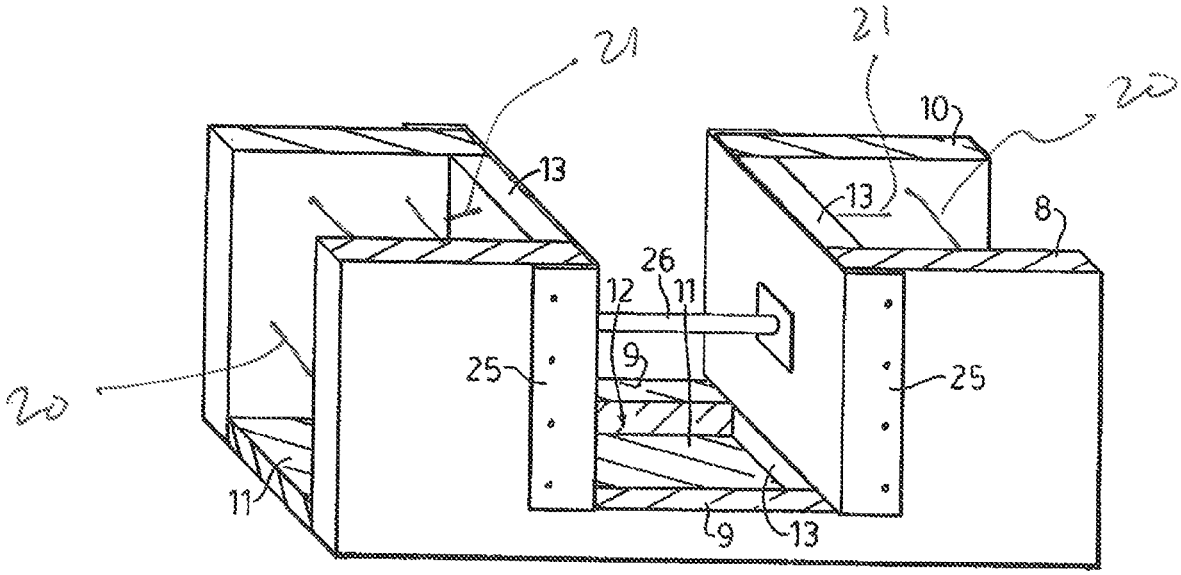
FIG. 8 is an isometric section view of the forms with opening forms, bulkhead and a support in place after the first concrete pour has been completed according to an embodiment of an ICF method.
Figure 9:
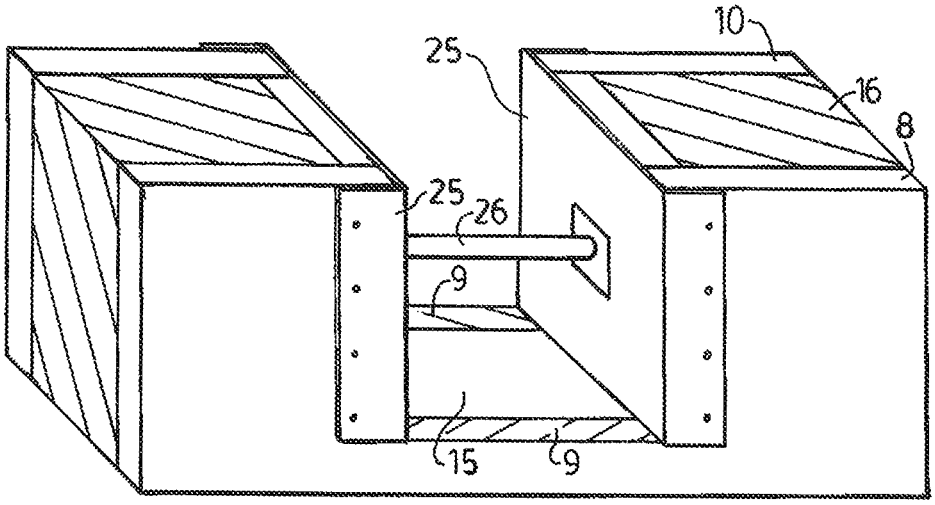
FIG. 9 is an isometric section view of the forms with opening forms, bulkhead and a support in place after a second concrete pour has been completed according to an embodiment of an ICF method.

FIG. 5 is a side view of the forms 8, 10 that illustrates a section plane AA taken through the forms 8, 10 to illustrate the ICF method in section view. FIGS. 7 to 9 illustrate stages in the method illustrating the bottom half of the forms 8,10 as sectioned by plane AA.

Figure 6:
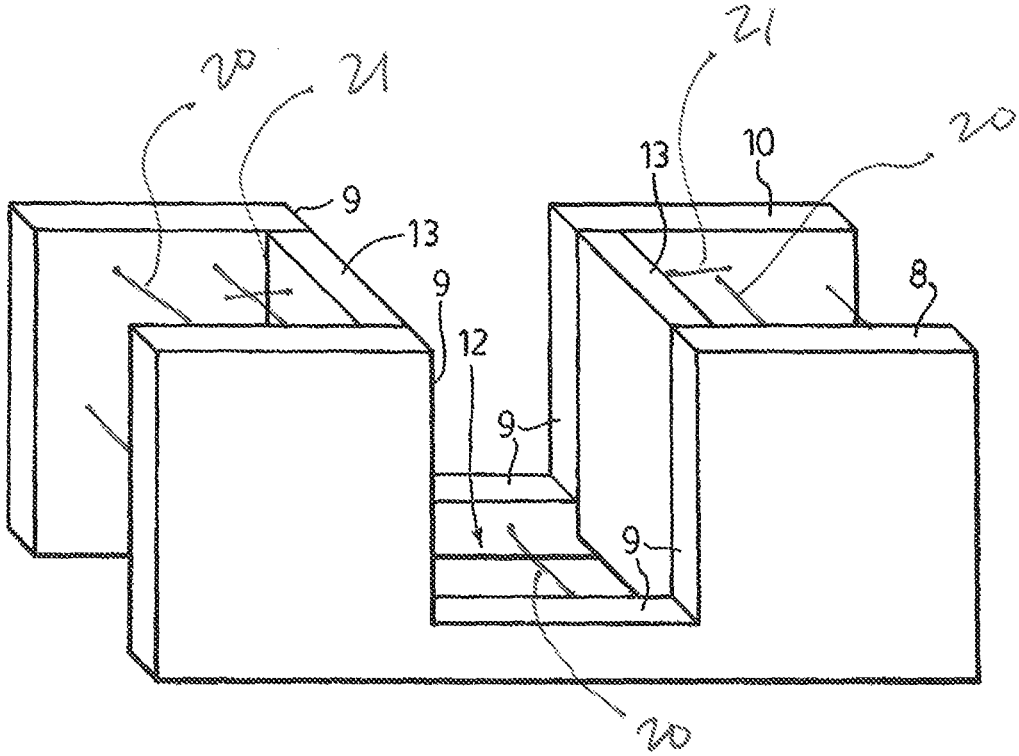
FIG. 6 is an isometric section view of the forms with opening forms in place in anticipation for a first concrete pour according to an embodiment of an ICF method.

FIG. 6 corresponds to FIG. 3 and illustrates the lower portion 12 of the structure opening 14 between the forms 8, 10 as bounded by the opening forms 13.

FIG. 7 illustrates the positioning of a temporary bulkhead 25 over an opening form 13. Holes in the bulkhead 25 permit the insertion of fasteners through the bulkhead 25 into the forms 8, 10 to secure the bulkhead in place.

FIG. 8 illustrates the bulkheads 25 in position fastened to the forms 8, 10 with a support 26 to brace the bulkheads 25. The concrete has been poured to a pour line 11 roughly in-line with a lower portion of the opening forms 13.

FIG. 9 illustrates the structure after the second concrete pour to create the core 16. The lower opening form 15 is in place between the forms 8, 10 positioned on the concrete at the pour line 11.

The ICF method described may be modified according to a particular ICF structure. In the case where the structure opening is narrow, or is located near an upper portion of the forms 8, 10, it may not be necessary to conduct a two step pour.

I claim:

1. A method of constructing an insulated concrete form structure having a structure opening through the structure, the structure opening defined by form edges and opening forms bonded to a concrete core of the structure, the method comprising:

erecting a set of spaced apart forms on a base;

positioning opening forms in the space between the forms around a form opening through the forms, and leaving an opening forms gap at a lower portion of the forms opening;

securing the opening forms around the form opening; and, pouring a first pour of concrete to fill the space between the forms up to the gap of opening forms;

positioning opening forms to close the opening forms gap and allowing the first pour of concrete to set;

pouring a second pour of concrete to fill the space between the forms from the top of the first pour around the opening forms to a top portion of the forms;

whereby the opening forms bond to the concrete core, the opening forms and the form edges defining the structure opening.

2. The method of claim 1 further comprising:

after pouring the first pour of concrete, agitating the concrete before positioning opening forms to close the opening forms gap.

3. The method of claim 2 wherein an agitator is inserted through the opening forms gap to agitate the concrete.

4. The method of claim 1 wherein the opening forms are secured by positioning bulkheads around the opening forms and fastening the bulkheads to outer surfaces of the spaced apart forms.

5. An insulated concrete form structure constructed using the method of claim 1.

6. An insulated concrete form structure produced by executing the method of claim 1.

* * * * *